US012053810B2

(12) United States Patent
Trumble et al.

(10) Patent No.: US 12,053,810 B2
(45) Date of Patent: Aug. 6, 2024

(54) METHODS OF SHEET METAL PRODUCTION AND SHEET METAL PRODUCTS PRODUCED THEREBY

(71) Applicant: Purdue Research Foundation, West Lafayette, IN (US)

(72) Inventors: Kevin Paul Trumble, West Lafayette, IN (US); Xiaolong Bai, West Lafayette, IN (US); Srinivasan Chandrasekar, West Lafayette, IN (US); James Mann, Avon, IN (US)

(73) Assignee: Purdue Research Foundation, West Lafayette, IN (US)

( * ) Notice: Subject to any disclaimer, the term of this patent is extended or adjusted under 35 U.S.C. 154(b) by 347 days.

(21) Appl. No.: 16/681,480

(22) Filed: Nov. 12, 2019

(65) Prior Publication Data

US 2020/0188972 A1 Jun. 18, 2020

Related U.S. Application Data

(60) Provisional application No. 62/758,184, filed on Nov. 9, 2018.

(51) Int. Cl.

| | |
|---|---|
| ***B21B 1/26*** | (2006.01) |
| ***C21D 8/02*** | (2006.01) |
| ***C21D 9/46*** | (2006.01) |
| ***C22F 1/04*** | (2006.01) |

(52) U.S. Cl.

CPC ..... *B21B 1/26* (2013.01); *C21D 8/0236* (2013.01); *C21D 9/46* (2013.01); *C22F 1/04* (2013.01)

(58) Field of Classification Search

CPC ..... B21B 1/26; C21D 8/0236; C21D 9/46; C22F 1/04

See application file for complete search history.

(56) References Cited

U.S. PATENT DOCUMENTS

| | | | |
|---|---|---|---|
| 4,073,214 | A | 2/1978 | Shaw et al. |
| 6,706,324 | B2 | 3/2004 | Chandrasekar et al. |
| 7,294,165 | B2 | 11/2007 | Chandrasekar et al. |
| 7,617,750 | B2 | 11/2009 | Moscoso et al. |
| 10,364,477 | B2 | 7/2019 | Kustas et al. |

(Continued)

OTHER PUBLICATIONS

Kustas et al. "Texture Development in High-Silicon Iron Sheet Produced by Simple Shear Deformation", Jun. 2016, The Minerals, Metals, & Materials Society and ASM International vol. 47A (Year: 2016).*

(Continued)

*Primary Examiner* — Adil A. Siddiqui

(74) *Attorney, Agent, or Firm* — Hartman Global IP Law; Gary M. Hartman; Domenica N. S. Hartman

(57) ABSTRACT

Processes for producing sheet metal products by machining a solid metal body with a cutting tool in a single step to continuously produce a continuous bulk form from material obtained from the solid metal body, and without performing a hot rolling operation thereon, cold rolling the continuous bulk form to produce a sheet metal product. The machining step is a large-strain machining process capable of being directly performed on an as-cast ingot or other solid body to produce a continuous intermediate product that can be directly cold rolled without any intervening hot rolling operation, and optionally without homogenization or annealing.

18 Claims, 9 Drawing Sheets

(56) References Cited

U.S. PATENT DOCUMENTS

| | | | | |
|---|---|---|---|---|
| 2014/0017113 | A1* | 1/2014 | Chandrasekar | B29C 48/08 420/402 |
| 2017/0058375 | A1* | 3/2017 | Kustas | C21D 8/0226 |

OTHER PUBLICATIONS

Brown, T.L. et al., "A Study of the Interactive Effects of Strain, Strain Rate and Temperature in Severe Plastic Deformation of Copper", Acta Materialia 57 (2009) pp. 5491-5500.
Brown, R.L., "Strip Fabricatoin Using Peeling Techniques", Material and Manufacturing Process, 4:4, (1989) pp. 467-481.
Chiffre, L.D., "Extrusion-Cutting", Int. J. Mach. Tool Des. Res., vol. 16, (1976) pp. 137-144.
Childs, T.H.C. et al., "Machining with Applied Chip Tension—Part II.Experiments", Int. J. Mech. Sci. vol. 28, No. 11 (1986) pp. 769-779.
Efe, M. et al., "Mechanics of Large Strain Extrusion Machining and Application to Deformation Processing of Magnesium Alloys", Acta Materialia 60 (2012) pp. 2031-2042.
Moscoso, W. et al., "Bulk Nanostructured Materials by Large Strain Extrusion Machining", J. Mater. Res., vol. 22, No. 1, (2007) pp. 201-205.
Zhang, F., et al., "Effect of Applied Tension on Quality of Brass Strip Manufactured by Extrusion Cutting", Annals of the CIRP, vol. 36/1 (1987) pp. 53-56.

* cited by examiner

FM
r = 0%
εt = 1.5

FM + CR
r= 10%
εt = 1.6

FM + CR
r= 26%
εt = 1.8

FM + CR
r = 45%
εt = 2.2

FM + CR
r= 58%
εt = 2.5

FM + CR
r= 68%
εt = 2.8

METHODS OF SHEET METAL PRODUCTION AND SHEET METAL PRODUCTS PRODUCED THEREBY

CROSS REFERENCE TO RELATED APPLICATIONS

This application claims the benefit of U.S. Provisional Application No. 62/758,184, filed Nov. 9, 2018. The contents of this prior application are incorporated herein by reference.

STATEMENT REGARDING FEDERALLY SPONSORED RESEARCH

This invention was made with government support under Contract No. DE-EE0007868 awarded by the U.S. Department of Energy, and under Contract No. CMMI 1363524 awarded by the National Science Foundation. The government has certain rights in the invention.

BACKGROUND OF THE INVENTION

The present invention generally relates to methods of producing bulk metal forms. The invention particularly relates to large-strain machining processes capable of being performed on as-cast ingots to produce continuous metal sheet products that can be directly cold rolled without any intervening hot rolling operations.

Commercial production of aluminum alloy sheet metal products from thick as-cast slabs (ingots) is commonly done through combinations of homogenization and multi-step hot rolling followed by multi-step cold rolling. As represented in FIG. 1, in a conventional process an alloy is direct-chill (DC) cast into ingots (step a), for example, to have dimensions as large as 2 m wide, 500 mm thick and 8 m long. The ingot is then homogenized (step b) at temperatures around 550° C. for up to about twenty-four hours to prepare for subsequent hot working processes such as hot rolling and hot extrusion. The hot ingot is transferred to a hot rolling line, which usually comprises breakdown hot rolling and tandem hot rolling mills. In breakdown hot rolling processes, the hot ingot is reversibly hot rolled (step c) with multiple passes to produce a transfer slab having a reduced thickness of, for example, about 30 mm. The transfer slab is hot rolled in a multi-stand hot rolling mill (step d) to a smaller gauge, for example, about 5 mm. The resulting intermediate product, referred to as a hot band, is usually coiled and slowly cooled before it is cold rolled (step e) to the desired final gauge thickness, for example, about 1 mm. After cold rolling, the aluminum sheet is heat treated in order to promote aging response and/or formability. The sheet is shown in FIG. 1 as passing through a continuous annealing line (step f), for example, at temperature of about 550° C., after which the sheet may be quenched for further deformation processing.

As evident from the above, the majority of sheet rolling reduction is achieved during hot rolling, during which larger deformations can be rapidly accomplished and defects such as porosity can be considerably eliminated. Thereafter, cold rolling is performed to achieve better dimensional control and surface finishes. Homogenization and high temperatures required by hot rolling to provide sufficient workability and achieve large reductions from a thick cast slab are energy intensive, and oxidation occurs and scale forms on surfaces during high temperature exposure that lead to poor surface finish and loss of metal. Because of these disadvantages associated with hot rolling, processes have been proposed for the purpose of reducing or eliminating the need for hot rolling operations in the production of sheet metal products from thick slabs. One such approach has been to directly cast thin plate (e.g., twin-roll casting). However, subsequent hot rolling and/or cold rolling are still required to control the resulting microstructure and properties of the sheet product. Various modifications of this approach have been investigated with limited commercial success.

BRIEF DESCRIPTION OF THE INVENTION

The present invention provides processes for producing sheet metal products by producing intermediate bulk forms that do not require hot rolling prior to one or more cold rolling steps that produce the sheet metal products.

According to one aspect of the invention, such a process includes machining a solid metal body with a cutting tool in a single step to continuously produce a continuous bulk form from material obtained from the solid metal body and, without performing a hot rolling operation thereon, cold rolling the continuous bulk form to produce a sheet metal product.

According to another aspect of the invention, the machining step is a large-strain machining process capable of being directly performed on an as-cast ingot to produce the continuous bulk form, optionally without homogenizing or annealing the solid metal body prior to the machining step. Other aspects of the invention include sheet metal products produced by such processes.

Technical aspects of methods as described above preferably include the capability of eliminating the need for multiple hot rolling conventionally required to produce sheet metal products from as-cast ingots and wrought forms (workpieces), and instead producing an intermediate product using a single machining-based deformation process, wherein the resulting intermediate product can be directly cold rolled without the need for preheating, homogenizing, annealing, or hot rolling the intermediate product prior to cold rolling to produce a sheet metal product. Consequently, the number of deformation (processing) steps conventionally used to produce sheet metal products can be greatly reduced. Reducing or eliminating massive hot-rolling lines and their associated run-out tables also greatly reduces the size of the production infrastructure compared to conventional rolling mills. The process has also been shown to be capable of imparting shear textures that enable unique and more controllable crystallographic textures and resulting properties (formability) in sheet metal products as compared to textures produced by conventional processes that require hot rolling an ingot prior to produce a cold-rolled sheet metal product.

Other aspects and advantages of this invention will be appreciated from the following detailed description.

BRIEF DESCRIPTION OF THE SEVERAL VIEWS OF THE DRAWING

FIG. 2A is a top view of strips produced by warm rolling to achieve 12% and 16% reduction per pass, FIG. 2B is a magnified image of the fracture surface of the sample of FIG. 2A rolled with 16% reduction per pass, and FIG. 2C is a magnified image showing the through-thickness microstructure of the warm-rolled sample with 16% reduction per pass, evidencing a wavy grain structure.

DETAILED DESCRIPTION OF THE INVENTION

The present disclosure describes large strain machining techniques that can be directly performed on as-cast ingots and wrought forms to produce sheet metal products without the requirement for hot rolling to produce an intermediate product in the form of a continuous bulk form that is suitable for cold rolling to produce a desired final sheet product, thereby avoiding high levels of thermal and mechanical energy associated with conventional hot rolling. The resulting intermediate product is capable of exhibiting unexpectedly high cold-rollability, even without annealing, which enables a reduction in the number of cold rolling steps otherwise needed to produce a sheet metal produce having a desired final thickness. The combined modes of deformation provide new levels of control of sheet microstructure and formability.

Figure 5:
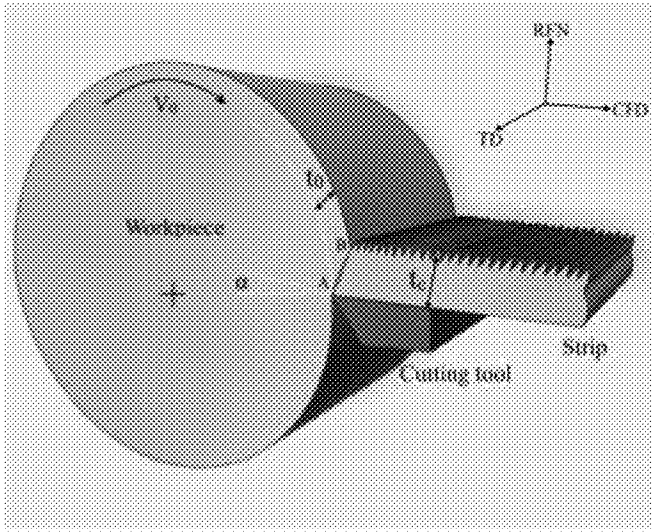
FIG. 5 schematically represents a free machining (FM) operation that may be used as an alternative to the LSEM operation represented in FIGS. 3 and 4 to produce the intermediate product.
Figure 4:
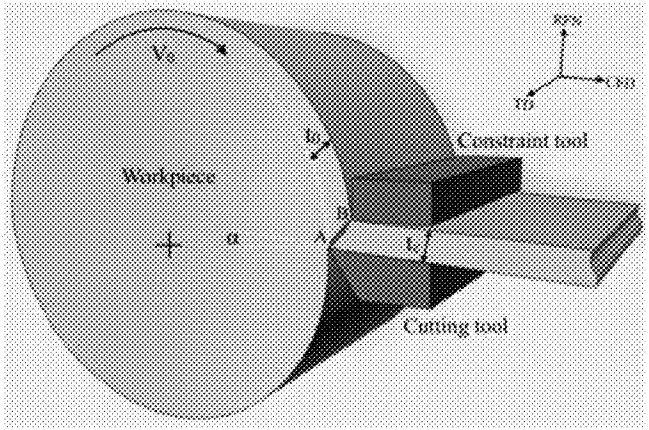
FIG. 4 schematically represents details of an LSEM operation of the type represented in step (b) of FIG. 3.

This disclosure is related to and utilizes certain machining-based deformation processes, including large strain free-machining ("FM," or "unconstrained") processes disclosed in U.S. Pat. Nos. 6,706,324 and 7,628,099, and constrained cutting processes referred to as large strain extrusion machining (LSEM) disclosed in U.S. Pat. Nos. 7,617,750, 7,895,872, 9,687,895 and 10,364,477. The contents of these prior patents are incorporated herein by reference. An LSEM operation of a type disclosed in U.S. Pat. Nos. 7,617,750, 7,895,872, 9,687,895 and 10,364,477 is schematically represented in FIG. 4, which depicts an intermediate product being produced by machining the surface of a workpiece with a cutting tool and extruding the resulting chip between the cutting tool and a constraint tool. An FM operation of a type disclosed in U.S. Pat. Nos. 6,706,324 and 7,628,099 is schematically represented in FIG. 5, which depicts an intermediate product being produced by machining the surface of a workpiece with a cutting tool without the use of a constraint tool to extrude the resulting chip. According to preferred aspects of the invention, machining-based deformation that occurs during the FM and LSEM processes are capable of producing intermediate products that can undergo further deformation, such as but not limited to cold rolling, to produce sheet metal products. These FM and LSEM processes further offer wide-ranging control of their machining-based deformation conditions to provide unique control of microstructure (e.g., grain size and texture) unlike rolling, some of which are described in the above-noted U.S. patents and therefore will not be detailed here.

Figure 1:
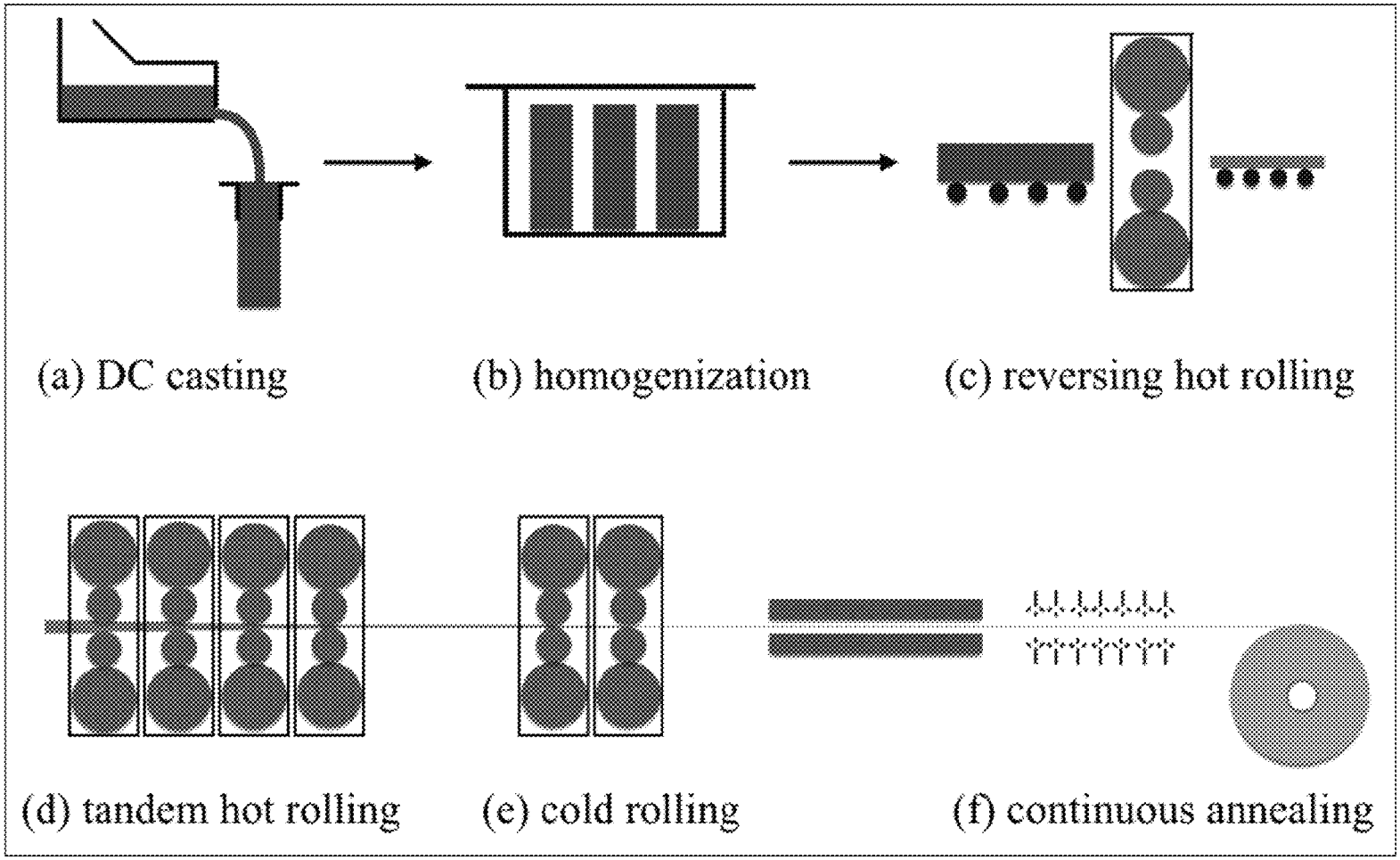
FIG. 1 (Prior Art)
FIG. 1 schematically represents steps conventionally carried out for the commercial production of sheet metal products, including aluminum alloy sheets.

The present disclosure describes the aforementioned large-strain machining-based FM and LSEM processes (hereinafter simply referred to FM and LSEM processes) performed on as-cast metal ingots and wrought forms in place of hot rolling to produce intermediate products that can be cold rolled as-is to produce a final sheet metal product having a desired thickness. Compared to conventional processes used to produce virtually all sheet metal products and that require multiple hot rolling operations to produce an intermediate strip product before undergoing multiple cold rolling operations (e.g., as represented in FIG. 1), it has been determined that FM and LSEM processes are capable of producing intermediate products that have properties that enable the intermediate products to undergo cold rolling without an intervening hot rolling operation. Various aspects and advantages of this invention will be appreciated from nonlimiting embodiments, investigations, etc., described below. Kustas et al., "Enhancing workability in sheet production of high silicon content electrical steel through large shear deformation," Journal of Materials Processing Tech. 257 (2018) 155-162, is a technical publication that relates to the present disclosure, the contents of which are incorporated herein by reference.

According to another nonlimiting aspect of the invention, the FM or LSEM processes can be performed on an as-cast metal ingot or wrought form at ambient temperature without prior homogenization or annealing to produce an intermediate product that does not require homogenization, annealing, or hot-rolling prior to cold rolling, in which case the FM or LSEM process replaces conventional homogenization, annealing, and hot-rolling operations. Investigations described below demonstrated that the FM and LSEM processes can produce the equivalent of a hot-rolled sheet ("hot band") in a single stage of deformation at ambient temperature (i.e., without preheating) on an ingot of a high-strength aluminum alloy that had not been homogenized (referred to herein as "as-cast") and on wrought forms of iron-silicon alloys that had not been annealed. Thus, large energy savings are possible by utilizing FM or LSEM instead of hot rolling by completely eliminating the thermal energy required for homogenization, annealing, and preheating, and by substantially reducing the mechanical energy of the multi-pass hot rolling with instead a single stage of large strain deformation by FM or LSEM.

The intermediate products produced by FM and LSEM were found to have unusually high cold rollability. Whereas hot rolling would normally result in a recrystallized (annealed) product necessary for cold rolling, the intermediate products produced by FM and LSEM at ambient temperature were in a heavily cold-worked condition (about three times higher hardness compared to the as-cast condition). Nevertheless, it was determined that the intermediate products could accommodate large cold-rolling reductions (greater than 60% reduction in a single step) without cracking, which was an unexpected capability. Microstructure and texture analysis suggested that the origin of this unexpected high workability in cold rolling was related to the unique shear textures imparted by the FM and LSEM processes. The investigations supported this hypothesis by demonstrating the comparatively limited cold rollability of an as-cast ingot, which in turn demonstrated a substantially simplified sheet production route via FM+cold rolling and LSEM+cold rolling in lieu of conventional multiple hot-rolling passes followed by multiple cold rolling passes.

Figures 9A, 9B, 9C, 9D, 9E:
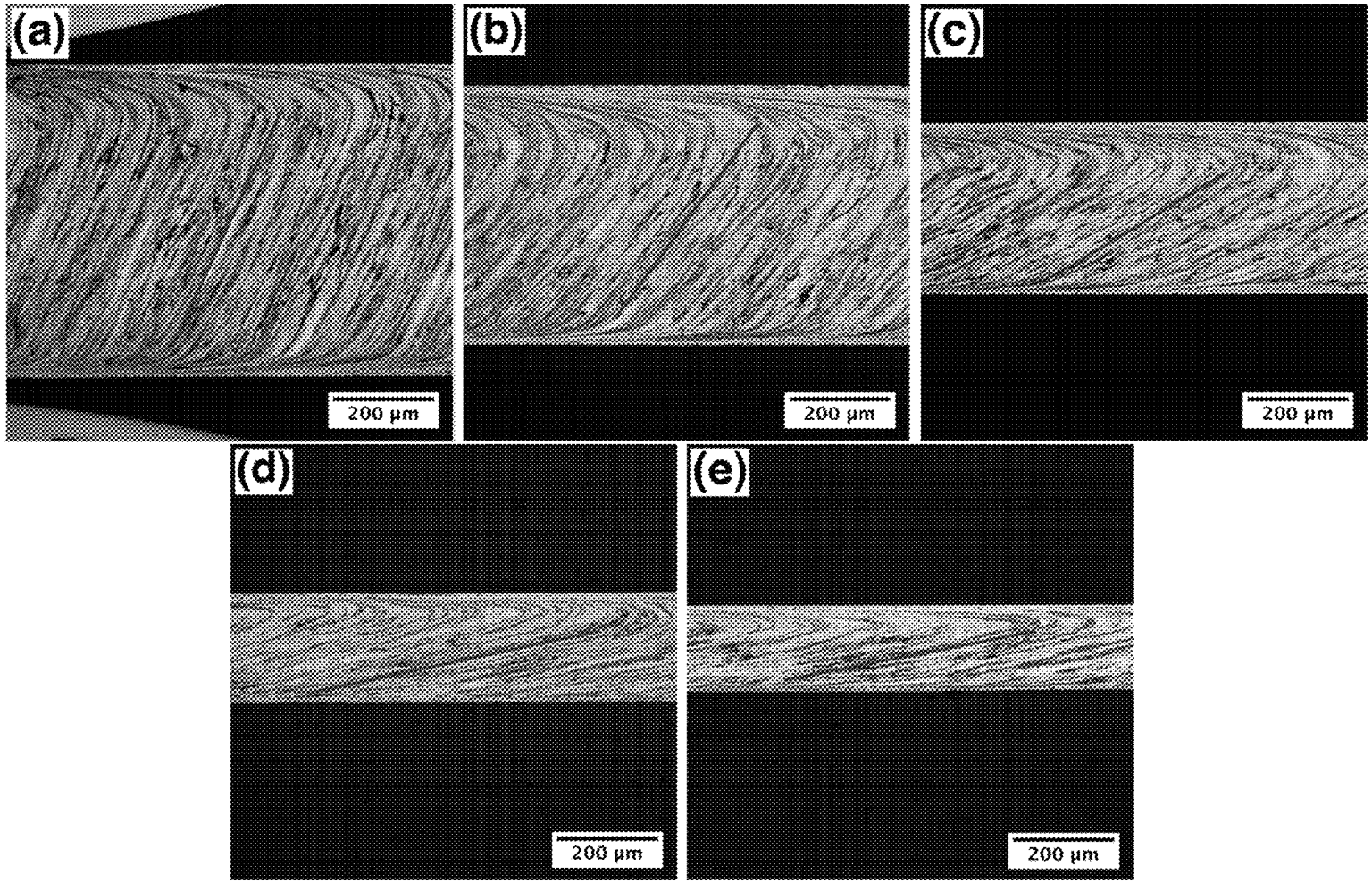
FIGS. 9A through 9E are a series of images showing the microstructures of an intermediate strip product that was produced by performing an LSEM operation on an as-cast AA6013 aluminum alloy ingot and prior to cold rolling (FIG. 9A), and a series of images showing the microstructures of sheet products produced by cold rolling intermediate strip products that were each similarly produced from the ingot with the LSEM operation and after performing a single cold rolling step to achieve a thickness reduction of 17% (FIG. 9B), 44% (FIG. 9C), 65% (FIG. 9D), or 73% (FIG. 9E).

FIGS. 9A through 9E are a series of images showing the microstructures of an intermediate strip product that was produced by performing an LSEM operation on an as-cast AA6013 aluminum alloy ingot and prior to cold rolling (FIG. 9A), and a series of images showing the microstructures of sheet products produced by cold rolling intermediate strip products each similarly produced from the ingot with the LSEM operation and after performing a single cold rolling step to achieve a thickness reduction of 17% (FIG. 9B), 44% (FIG. 9C), 65% (FIG. 9D), or 73% (FIG. 9E). All of the microstructures exhibit a strong shear texture, and the intermediate strip products exhibited exceptional cold rollability.

Figure 6:
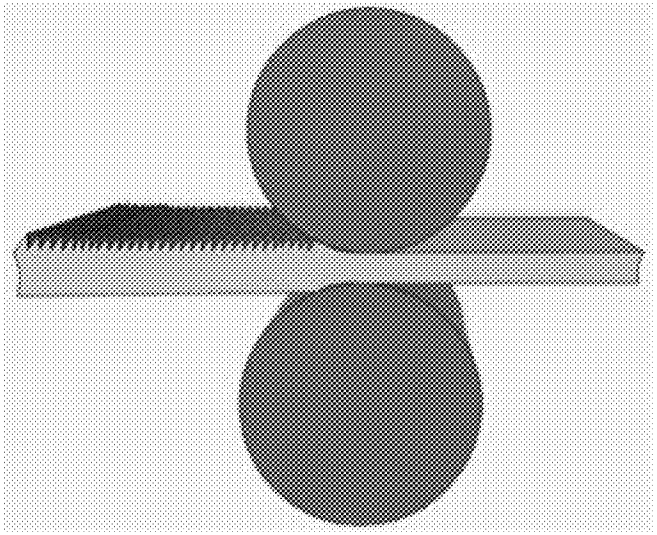
FIG. 6 schematically represents a cold rolling operation being performed on the intermediate product produced by the FM operation represented in FIG. 5.
Figure 7:
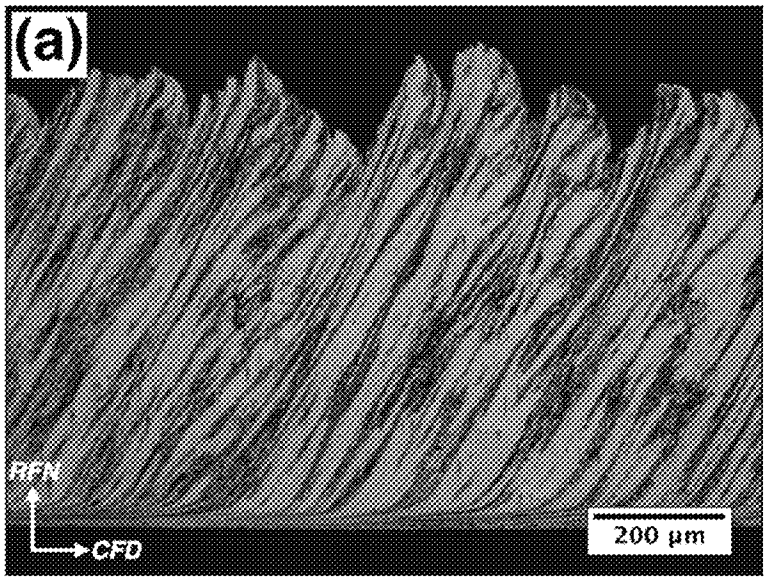
FIGS. 7 and 8 are images showing the microstructures of intermediate strip products produced by FM and LSEM operations, respectively, performed on an as-cast AA6013 aluminum alloy ingot.
Figure 8:
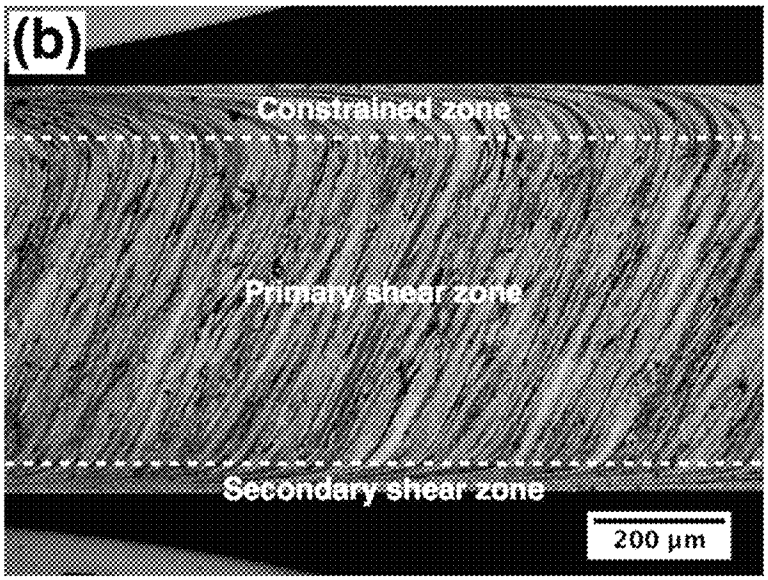

Though intermediate strip products (chips) produced by FM, i.e., using a cutting tool without a constraint tool, generally had a strong shear texture similar to the intermediate strip products produced by LSEM, without use of the LSEM constraint tool the backside surface (opposite the cutting tool) of an FM-produced intermediate product is rough, as schematically portrayed in FIG. 5. FIGS. 7 and 8 are images evidencing, respectively, rough versus smooth backside surfaces of intermediate strip strips that were produced by FM and LSEM operations performed on an as-cast AA6013 aluminum alloy ingot. During cold rolling of intermediate strip products produced by FM, it was found that the intermediate strip products exhibited exceptional cold rollability and that the backside surface roughness was able to be readily smoothed by cold rolling, sometimes in a single cold rolling operation as schematically depicted in FIG. 6. It was not intuitive or expected that cold rolling would uniformly smooth the surface roughness of an FM intermediate product, as opposed to folding over the asperities and creating surface sliver defects that occur in hot rolling. As such, an FM plus cold rolling sequence also provides a unique route to producing smooth sheet metal products (smooth on both major surfaces) with shear texturing, but in a simpler process that does not employ a constraint tool. On the other hand, intermediate products directly produced by an LSEM process can have various profile forms (bar, rod, wire, etc.) through the use of contoured cutting and/or constraining tools, in addition to the flat forms (strip, plate, sheet, foil, etc.) produced by cutting and constraining tools as schematically represented in FIG. 4 and produced by a cutting tool as schematically represented in FIG. 5.

The investigations evidenced that enhanced formability is also observed in sheet metal products produced by LSEM+cold rolling and by FM+cold rolling. The final sheet metal products produced by both of these processes had structures and properties that were unique. As the shear textures and microstructures from the FM and LSEM processes enhanced cold-rollability for finishing the sheet product itself, they also affected the formability of the sheet metal products, for example, during stamping, bending, drawing, etc., and the general manufacturability of the sheet metal products, for example, during cutting, grinding, drilling, welding, etc. The unique structures (shear textures) of the sheet metal products were readily observable under examination. By analogy to the routes involving intermediate flat forms by LSEM or FM, profile forms can be combined with another deformation process for finishing (e.g., rolling, drawing, etc.).

In the investigations, FM and LSEM were performed as shear-based single-step deformation processes to create strips directly from as-cast AA6013 ingots without homogenization, which in conventional sheet production processes (e.g., FIG. 1) is usually conducted on AA6013 ingots at temperatures of 480 to 580° C. for up to 48 hours. For the investigations, commercial AA6013-T6 aluminum plates were obtained having a chemical composition (wt. %) of about 0.66 Si, 0.27 Fe, 0.62 Cu, 0.29 Mn, 0.94 Mg, 0.021 Cr, 0.008 Ni, 0.024 Zn, 0.017 Ti, 0.15 other, and the balance Al. The alloy was remelt in air and cast into disks with diameters of about 150 mm and thicknesses of about 16 mm thickness.

The FM and LSEM processes were performed on as-cast disks at room temperature to produce intermediate strip products. Cutting conditions employed by the FM investigations included a rake angle ($\alpha$) of 5°, a cutting velocity ($V_0$) of 6 m/s (1200 f/m), and cutting conditions employed by the LSEM investigations were conducted to produce a chip thickness ratio ($\lambda$) of 2.5 ($t_0$=0.25 mm, $t_c$=0.625 mm) with the same rake angle and velocity as the FM investigations. As previously noted, the constraint tool used by the LSEM process confines the flow of material at the free surface of a workpiece so that both sides of the resulting intermediate product are smooth. Furthermore, the final chip thickness, $t_c$, is controllable by the constraint tool, whatever is larger or less than the initial cutting depth $t_0$. The chip thickness ratio ($\lambda=t_c/t_0$) and the rake angle ($\alpha$) determine the final strain ($\gamma$) imposed on the sheet. During the LSEM process, shear deformation is confined to a very narrow zone, from the cutting tool tip "A" to the constraint tool edge "B" in FIG. 4. The FM and LSEM intermediate strip products were cold rolled in a single step in a laboratory rolling mill with a roll diameter of about 100 mm. Parameters of the FM and LSEM processes are summarized in Table 1.

TABLE 1

| | α (°) | $V_0$ (m/s) | $t_0$ (mm) | $t_0$ (mm) | λ | ε | Hv (kgf/mm$^2$) |
|---|---|---|---|---|---|---|---|
| FM | 5 | 6 | 0.25 | 0.71 | 2.8 | 1.7 | 98 ± 3 |
| LSEM | 5 | 6 | 0.25 | 0.63 | 2.5 | 1.6 | 88 ± 3 |

For comparison, warm rolling experiments were also performed on as-cast specimens to achieve approximately the same effective strain and temperature as the LSEM process. Because a temperature rise of about 150° C. was estimated for the LSEM specimens, the warm rolled specimens were preheated to about 300° C. to ensure that the deformation temperature during warm rolling process was not less than that in LSEM process. The warm rolling parameters are reported in Table 2. Warm rolling was terminated upon cracking of the specimens.

TABLE 2

Figure 2B:
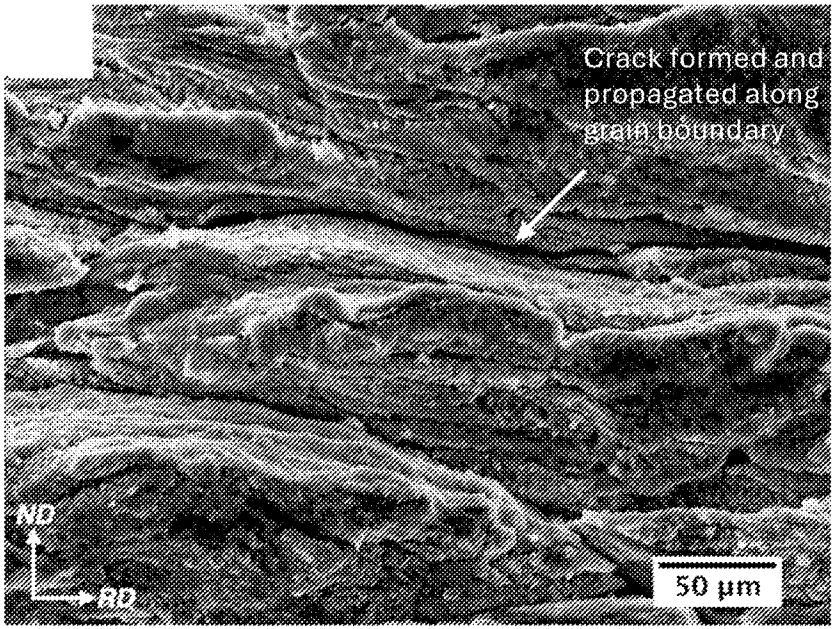
FIG. 2B (Prior Art)
FIGS. 2A, 2B, and 2C represent results from attempting to produce strips by warm rolling as-cast 6013 aluminum alloy.
Figure 2C:
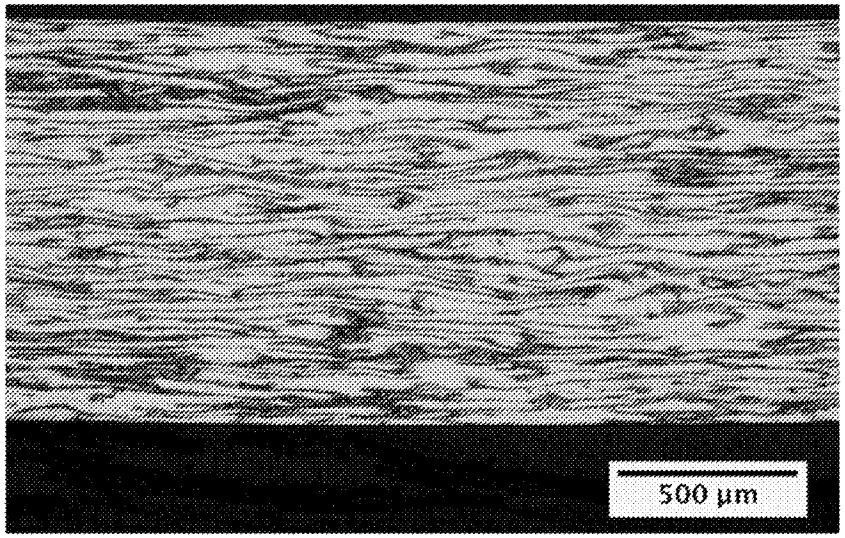
FIG. 2C (Prior Art)
Figure 2A:
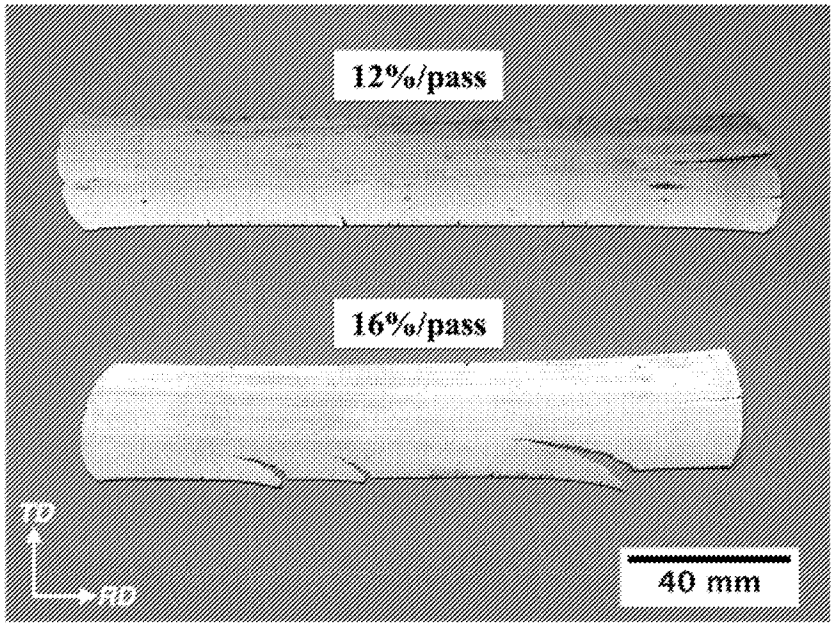
FIG. 2A (Prior Art)

| $t_i$ (mm) | r/pass | N | $t_f$ (mm) | $\varepsilon_w$ |
|---|---|---|---|---|
| 4.8 | 12% | 11 | 1.2 | 1.6 |
| 4.2 | 16% | 8 | 1.1 | 1.5 |

where $t_i$ is initial thickness, r/pass is percent reduction per warm rolling pass, $t_f$ is final thickness, and $\varepsilon_w$ is effective strain in warm rolling. N is the total number of warm rolling passes completed prior to the specimen cracking. FIG. 2A shows the specimens following the warm rolling step that produced cracks in the specimen. Fractures on edges of the specimen warm rolled to achieve a 12% reduction per pass (12%/pass) were much smaller than the specimen rolled to achieve a 16% reduction per pass (16%/pass), even though they underwent the same strain during warm rolling. Slip was the main mechanism for plastic deformation and, due to limited slip systems, deformation was usually restricted in certain crystallographic planes and directions. Cracks formed and propagated along grain boundaries as shown in FIG. 2B, which were dominated by transgranular fracture mode. Due to large constituent particles, especially along grain boundaries, shear strain developed around these particles and penetrated through several grains, such that a wavy grain structure was obtained along the rolling direction (FIG. 2C).

Through-thickness microstructures of specimens of the FM, LSEM, and warm-rolled intermediate strip products as well as an as-cast specimen were prepared for optical microscopy examination by mechanical grinding using 320 to 2000 grit abrasive paper and final polishing with colloidal silica, followed by etching with 10% weight percent sodium hydroxide between 2 and 5 minutes. Microhardness of the specimens were measured by Vickers indentation with loads ranging from 50 g to 100 g to ensure a similar indentation size and at least 10 indentations are measured to obtain an average of the hardness.

The microstructure along the radial direction of the as-cast specimen revealed a fine equiaxed grain structure with an average grain size 194 m, as measured by linear intercept method. During the solidification process, dendrite grew along the heat flow direction and porosity formed between the dendrites because the flow of the liquid was confined. This small amount of porosity can be removed in the deformation processes such as rolling and extrusion. Large constituent phases with sizes as large as 4 m formed during solidification and the subsequent cooling processes, and small second-phase particles precipitated along grain boundaries.

Figure 11:
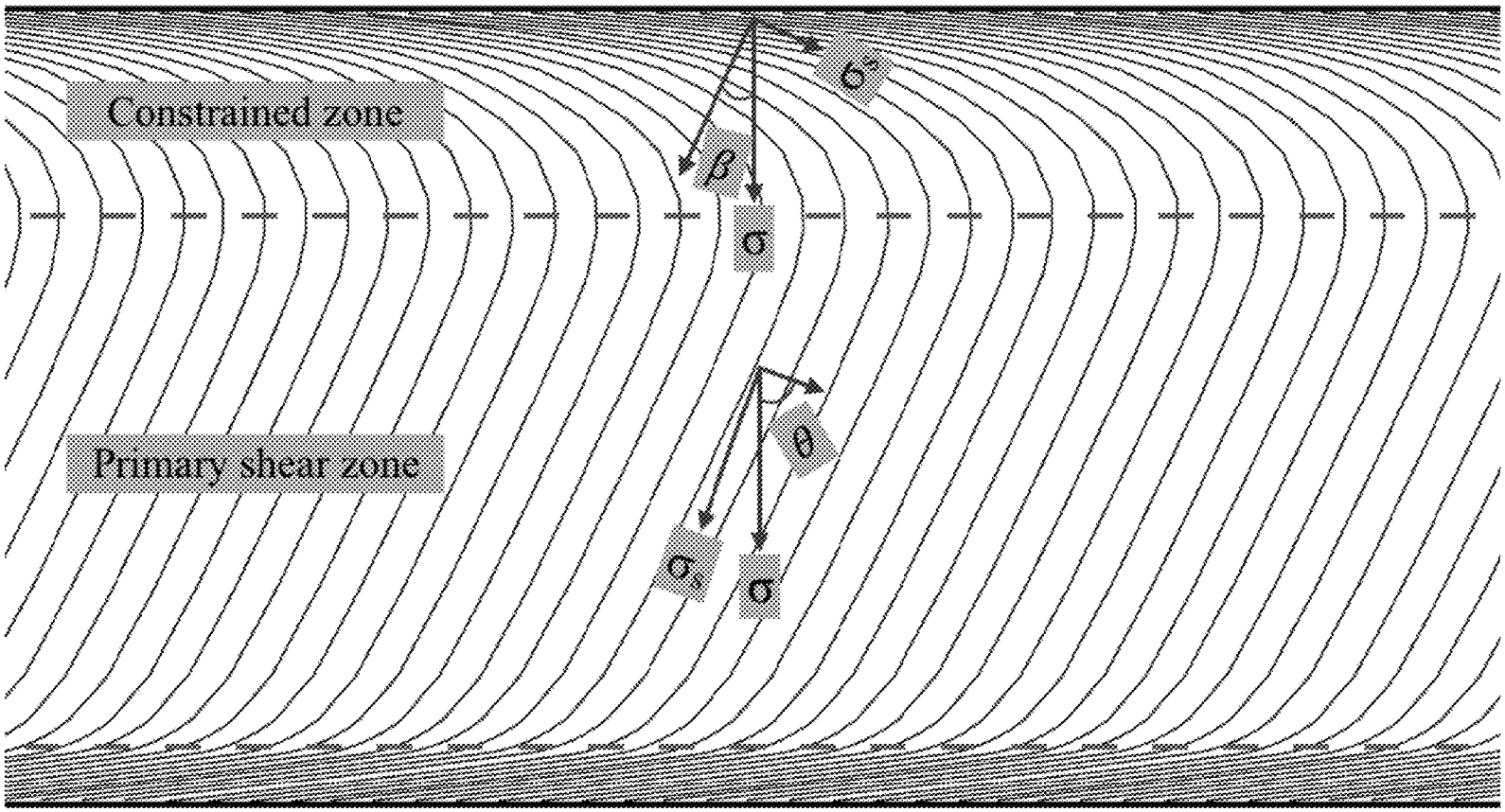
FIG. 11 schematically represents a flow line-type microstructure in a sheet/strip product produced by an LSEM operation and identifies constrained and primary shear zones within the microstructure, where $\sigma$ is the compression imposed on the product during rolling, $\sigma_s$ is the resolved shear stress along shear plane direction, and $\beta$ and $\theta$ are rotation angles of textures in the constrained and primary shear zones.

The backside surface of the FM specimens were rough, whereas the tool side surfaces of the specimens was smooth (FIG. 7). Both the backside and tool-side surfaces of the LSEM specimens were smooth due to the confinement by the constraint tool (FIG. 8). In conventional rolling processes, lamellar grain structure develops and the grains are elongated along the rolling direction (RD). In the FM and LSEM processes, however, flow-line type grain structures formed and the initial equiaxed as-cast coarse grains were elongated along the maximum tensile direction. The specimens produced by the LSEM process exhibited grains with inclination angles that were different between different zones due to distinct shear (FIG. 8). Shear in a "secondary shear zone" and a "constrained zone" at the tool-side surface and the backside surface, respectively, of the specimens resulted from friction between the intermediate strip product and the cutting tool and between the intermediate strip product and the constraint tool, and shear in an interior "primary shear zone" (between the secondary shear zone and constrained zone) originated from the cutting on the tip of the cutting tool. These shear zones are schematically represented in FIG. 11, and are characterized by grains with inclination angles relative to the backside and tool-side surfaces of the product. In FM and LSEM specimens of FIGS. 7 and 8, the inclination angles of the grains in the primary shear zones of the intermediate products were very similar, about 65 degrees, due to being produced by similar effective strain conditions.

The hardnesses of the LSEM and FM specimens were 88 and 98, but both were higher than the as-cast specimen (64±2) due to a work hardening effect. In the LSEM experiment with λ=2.5, the temperature rise in the intermediate strip product was higher than in the FM intermediate strip product because of a larger hydrostatic pressure and greater effective strain, so the hardness of LSEM specimen was concluded to be lower than that of the FM specimen due to a lower strain and higher level of recovery.

Cold rolling was performed on the LSEM intermediate strip products with parameters shown in Table 3, not only to refine surface roughness, but also to control the microstructure and texture of the LSEM specimens. From Table 3 it can be seen that the LSEM intermediate strip products were remarkably rollable in a single cold-rolling step. In the LSEM process, continuous intermediate strip products were produced with an effective strain ε=1.6, and the highly deformed intermediate strip products were cold rolled with up to 73% reduction in one step without any cracking, for which the total effective strain was $\varepsilon_t$=3.1. The hardness of the specimens increased with increasing reduction, but hardness remained very stable for specimens cold rolled to more than 44% reduction, changing from 98 at 44% reduction to 100 at 73% reduction. The possible reason was that the work hardening effect saturated at such a high strain.

TABLE 3

| $t_i$ (mm) | r | $t_f$ (mm) | $\varepsilon_c$ | $\varepsilon_t$ | Hv (kgf/mm$^2$) |
|---|---|---|---|---|---|
| 0.63 | 17% | 0.52 | 0.2 | 1.8 | 94 ± 3 |
| 0.63 | 44% | 0.35 | 0.7 | 2.3 | 98 ± 2 |
| 0.63 | 65% | 0.22 | 1.3 | 2.9 | 99 ± 1 |
| 0.63 | 73% | 0.17 | 1.5 | 3.1 | 100 ± 2 |

where $t_i$ is initial thickness, $t_f$ is final thickness, $\varepsilon_c$ is effective strain in cold rolling, and $\varepsilon_t$ is total effective strain (effective strain in LSEM and effective strain in cold rolling).

Figure 12:
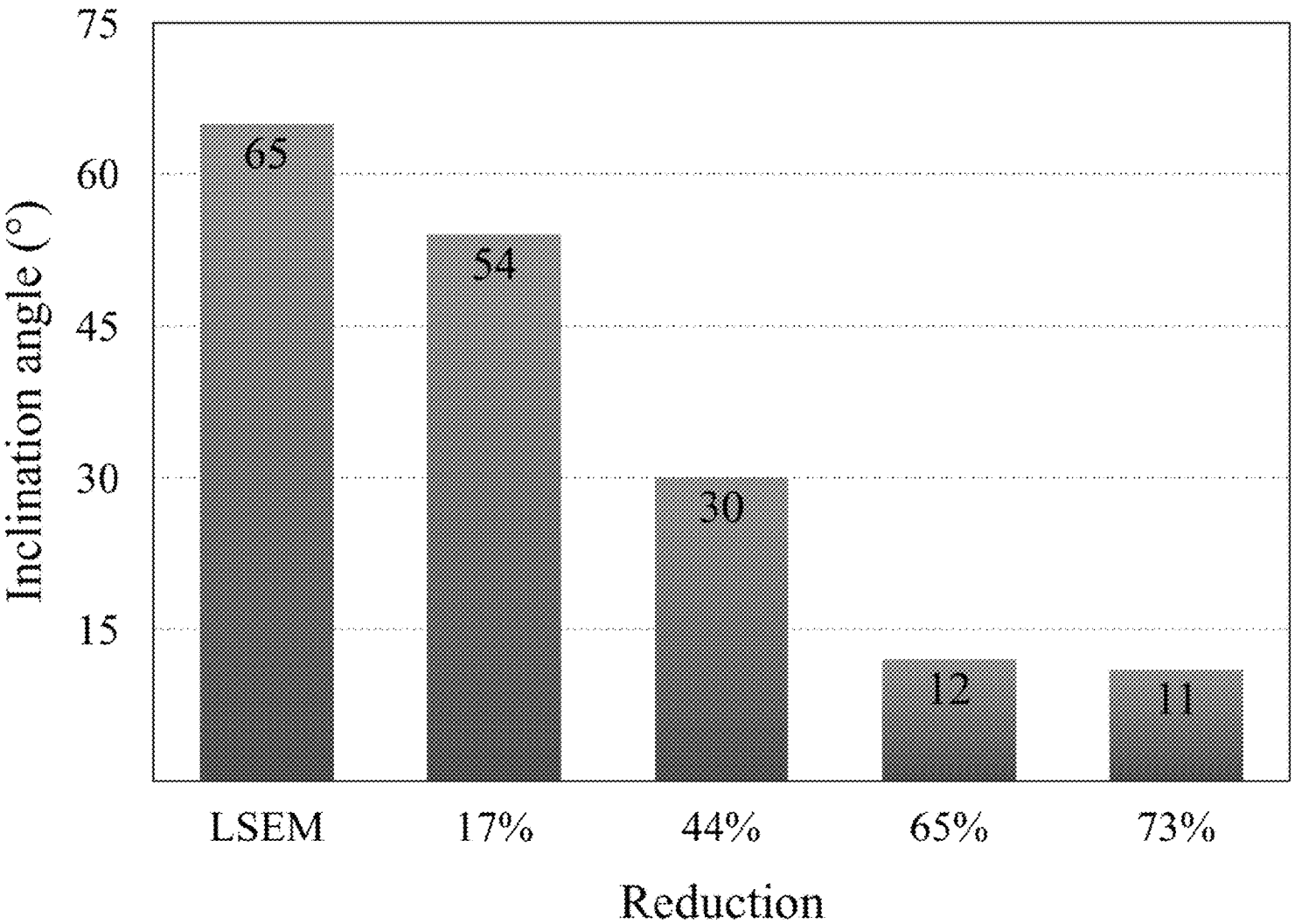
FIG. 12 is a bar graph plotting the inclination angles of grains in the primary shear zones of the LSEM intermediate product and sheet products of FIGS. 9A through 9E.

No cracks developed in any of the LSEM specimens. The microstructures of the cold rolled LSEM specimens (FIGS. 9B-9E) were similar to that of the LSEM intermediate strip product (FIG. 9A). Each had a constrained zone, primary shear zone, and secondary shear zone, but the inclination angles of grains in the primary shear zones were different. The inclination angle of grains in the primary shear zone of the LSEM intermediate strip product was about 65° (FIG. 9A). With increasing reduction, the inclination angle decreased and finally become very stable, as evident from FIGS. 9D and 9E and FIG. 12. Another difference was the thicknesses of grains. The as-cast 6013 alloy ingot has an equiaxed grain structure with grain sizes of about 194 μm. During the LSEM process, grains were elongated toward the maximum tensile direction while the thickness of the grains decreased to about 35 μm. Grain thickness of LSEM specimens that underwent cold rolling were reduced from about 30 μm at 17% reduction to as small as 15 μm at 65% reduction. This considerable reduction in grain thickness may have played an important role in the subsequent annealing process.

For comparison, a cold rolling experiment was conducted on strips cut from each of the warm-rolled specimens previously described. The cold rolling parameters for the warm-rolled specimens are shown in Table 4. The sizes of the specimens cut from the 12%/pass and 16%/pass warm-rolled specimens were about 40 mm×8 mm×1.1 mm (L×W×T), and the specimens were cold rolled to achieve a 17%, 26%, 46%, 65%, or 72% reduction in a single step.

TABLE 4

| $t_i$ (mm) | r | $t_f$ (mm) | $\varepsilon_c$ | $\varepsilon_t$ |
|---|---|---|---|---|
| 1.1 | 17% | 0.91 | 0.2 | 1.8 |
| 1.1 | 26% | 0.81 | 0.3 | 1.9 |
| 1.1 | 46% | 0.59 | 0.7 | 2.3 |
| 1.1 | 65% | 0.38 | 1.3 | 2.9 |
| 1.1 | 72% | 0.31 | 1.5 | 3.1 |

where $t_i$ is initial thickness, r is percent reduction, $t_f$ is final thickness, $\varepsilon_c$ is effective strain in cold rolling, and $\varepsilon_t$ is total effective strain (effective strain in warm rolling and effective strain in cold rolling). The specimens were free of cracks after the 17% reduction but, unlike the cold-rolled LSEM specimens, the warm-rolled specimens fractured when cold rolled to achieve 26% reductions or more.

Figure 10:
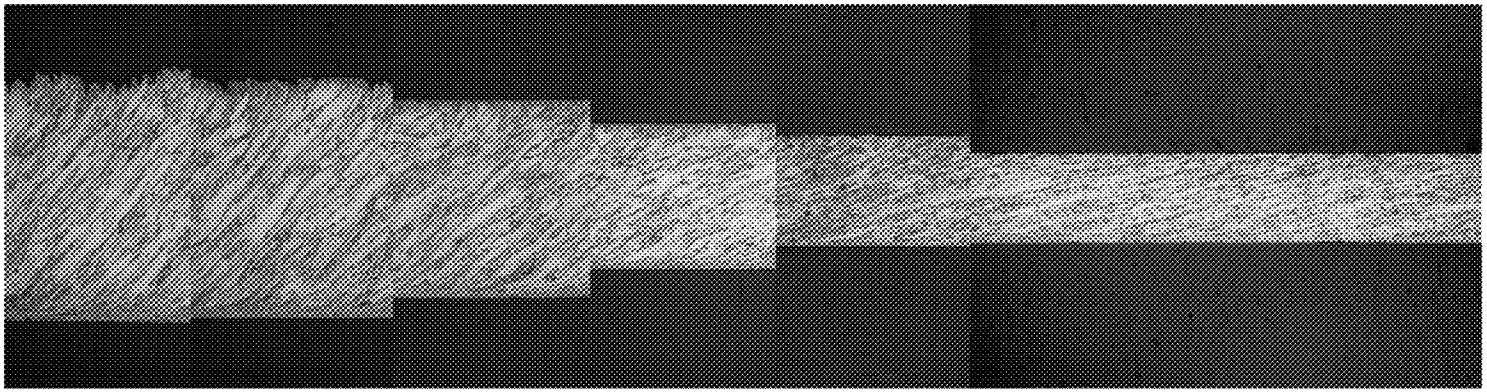
FIG. 10 contains an image of the microstructure of an intermediate strip product that was produced by performing an FM operation on a warm-rolled wrought Fe-1% Si alloy and prior to cold rolling (r=0%), and a series of images showing the microstructures of sheet product produced by cold rolling intermediate strip products that were each similarly produced from the Fe-1% Si alloy with the FM operation and after performing a single cold rolling step to achieve a thickness reduction of 10%, 26%, 45%, 58%, or 68%.

FIG. 10 contains a series of micrographs of products produced by FM from a warm-rolled wrought Fe-1% Si alloy workpiece. The micrographs show an intermediate strip product as produced by FM (reduction (r)=0%, as well as sheet products produced from intermediate strip products that underwent single-step cold rolling to achieve different thickness reductions (r=10%, 26%, 45%, 58%, and 68%). This investigation evidenced that reduction results achieved by cold rolling LSEM intermediate products can also be achieved by cold rolling FM intermediate products. The investigation further evidenced that, with a reduction of greater than 10%, the initially rough backside surfaces of the intermediate products could be smoothed to achieve a surface roughness approximately equivalent to their corresponding and initially smooth tool-side surfaces.

It can be noted that, in FM and LSEM specimens of FIGS. 7, 8, 9A, and 10, the inclination angles of the grains in the primary shear zones of the intermediate products were very similar, about 65 degrees, due to being produced by similar effective strain conditions. Furthermore, the inclination angles of the grains in the primary shear zones of the final sheet products of FIGS. 9B-9E and 10 were also very similar, about 10 degrees to less than 65 degrees, due to being produced by similar cold rolling conditions. Depending on LSEM and FM conditions, inclination angles are expected to be generally in a range of about 45 to 90 degrees in intermediate products, and inclination angles can be less than 10 degrees in final products, depending on LSEM, FM, and cold rolling conditions.

The results reported above evidenced that continuous intermediate products in continuous bulk forms can be produced by FM and LSEM processes from as-cast 6013 aluminum alloy without homogenization, and that such intermediate products can be directly cold rolled without first undergoing hot rolling. Furthermore, reductions of at least 73% can be achieved by cold rolling FM and LSEM intermediate products in a single step without cracking, indicating that the non-homogenized as-cast 6013 aluminum alloy was able to withstand a total effective strain of 3.1 at room temperature. In contrast, cracks developed when attempting to warm roll the same as-cast 6013 aluminum alloy with the same effective strain as LSEM, and cracks developed when attempting to cold roll warm-rolled specimens to achieve reductions of 26% or more. These results indicate a significant advantage over conventional rolling processes (FIG. 1) in which homogenization and hot rolling (including reversing and tandem hot rolling) require considerable energy, time, and space. By controlling the FM and LSEM parameters, FM and LSEM intermediate products can be manufactured to have a wide range of thicknesses.

In commercial rolling production of aluminum alloy sheets, homogenization is an integral part of the processing route. This high-temperature heat treatment is usually performed after casting, and benefits not only subsequent hot rolling deformation, but also final aging processes by promoting a homogenous distribution of alloy elements, such as Mg, Cu and Si. In the FM and LSEM processes, continuous intermediate products were obtained from as-cast alloys without homogenization. As such, homogenization was not required to achieve the disclosed reductions. However, segregation in alloy elements is not favorable for aging processes unless homogenization is achieved, and therefore a homogenization step may be desirable, for example, during a solution heat treatment (annealing) process.

Figure 3:
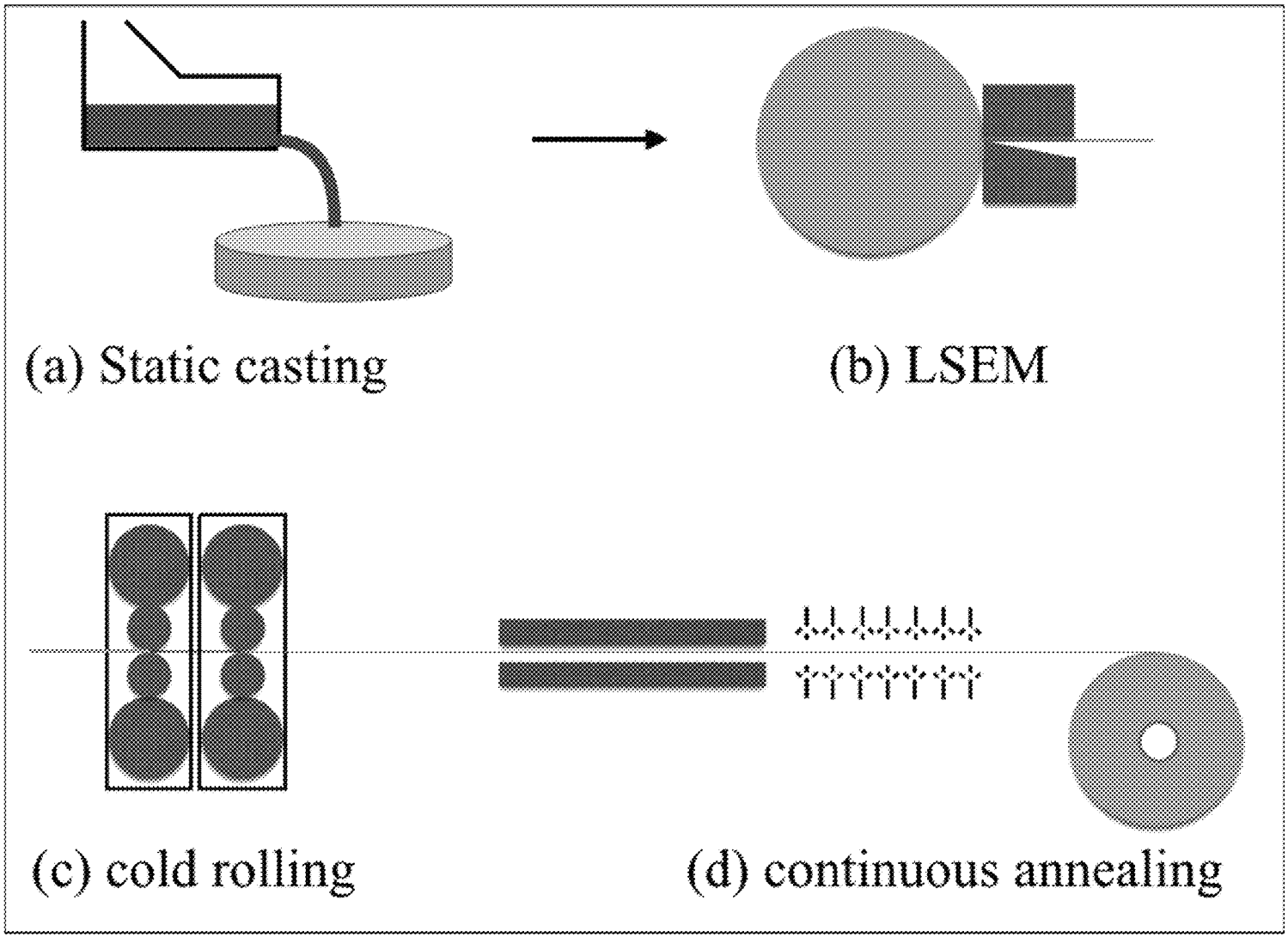
FIG. 3 schematically represents steps for producing a sheet metal product by performing a large strain extrusion machining (LSEM) operation on an as-cast ingot to produce an intermediate product that subsequently undergoes cold rolling to produce the sheet metal product in accordance with a nonlimiting embodiment of the invention.

In view of the forgoing, FIG. 3 is believed to represent a nonlimiting example of a process of producing metal sheet products from intermediate products machined directly from an as-cast or wrought form. In FIG. 3, an alloy is static cast to form a workpiece whose free surface is then subjected to large-strain FM or (as represented in FIG. 3) LSEM without necessarily undergoing homogenization or annealing prior to machining. The FM or LSEM process can be performed at room temperature, and the resulting continuous intermediate products can then undergo one or more cold rolling operations to obtain sufficient reduction to achieve a desired final thickness. Thereafter, the resulting cold-rolled sheet products may be annealed, for example, by a solution heat treatment at a temperature of about 560° C., to obtain an age hardening response and promote formability.

While the invention has been described in terms of particular embodiments and investigations, it should be apparent that alternatives could be adopted by one skilled in the art. For example, FM and LSEM equipment could differ from what is schematically shown and described, process parameters could be modified, and other materials could be processed in place of the aluminum and FeSi alloys evaluated. As such, it should be understood that the detailed description is intended to describe the particular embodiments represented herein and certain but not necessarily all features and aspects thereof, and to identify certain but not necessarily all alternatives to the embodiments and their described features and aspects. Accordingly, it should be understood that the invention is not necessarily limited to any embodiment described or illustrated herein, and the phraseology and terminology employed above are for the purpose of describing the disclosed embodiments and investigations and do not necessarily serve as limitations to the scope of the invention. Therefore, the scope of the invention is to be limited only by the following claims.

The invention claimed is:

1. A process comprising:

machining a solid metal body with a cutting tool in a single step to continuously produce a continuous bulk form from material obtained from the solid metal body, wherein the solid metal body is an aluminum alloy or an FeSi alloy; and without performing a hot rolling operation thereon, cold rolling the continuous bulk form to produce a sheet metal product without cracking, wherein the cold rolling step reduces a thickness of the continuous bulk form by greater than 35% in a single pass of the cold rolling step without cracking.

2. The process according to claim 1, wherein the machining step is a large-strain free-machining process performed with the cutting tool.

3. The process according to claim 2, wherein the large-strain free-machining process produces the continuous bulk form to have a backside surface opposite the cutting tool that is rougher than a tool-side surface of the continuous bulk form produced by the cutting tool, and the backside surface is smoothed by the cold rolling step.

4. The process according to claim 1, wherein the machining step is a large-strain extrusion machining process performed with the cutting tool and a constraint tool.

5. The process according to claim 4, wherein the large-strain extrusion machining process produces the continuous bulk form to have a tool-side surface produced by the cutting tool and a backside surface produced by the constraint tool, and the sheet metal product has a secondary shear zone at the tool-side surface, a constraint zone at the backside surface, and an interior primary shear zone therebetween in which grains are inclined relative to the backside and tool-side surfaces of the sheet metal product.

6. The process according to claim 1, wherein the process is performed without performing a homogenization process on the solid metal body or the continuous bulk form prior to the cold rolling step.

7. The process according to claim 1, further comprising heat treating the sheet metal product after the cold rolling step.

8. The process according to claim 1, wherein the cold rolling step reduces a thickness of the continuous bulk form by at least 73% in a single pass of the cold rolling step.

9. The process according to claim 1, wherein the continuous bulk form is an intermediate profile product chosen from the group consisting of bars, rods and wires.

10. The process according to claim 1, wherein the continuous bulk form is an intermediate flat product chosen from the group consisting of strips, plates, sheets, and foils.

11. The process according to claim 1, wherein the solid metal body is a casting.

12. The process according to claim 1, wherein the solid metal body is a wrought form.

13. The process according to claim 1, wherein the solid metal body is an aluminum alloy.

14. The sheet metal product produced by the process of claim 13.

15. The process according to claim 1, wherein the sheet metal product has an interior primary shear zone in which grains are inclined by about 65 degrees or less to a surface of the sheet metal product.

16. The process according to claim 15, wherein the grains in the interior primary shear zone are inclined by about 11 degrees or more to the surface of the sheet metal product.

17. The sheet metal product produced by the process of claim 16.

18. The process according to claim 1, wherein the cold rolling step reduces a thickness of the continuous bulk form by greater than 60% in a single pass of the cold rolling step without cracking.

* * * * *